US006786334B2

(12) United States Patent
Smith

(10) Patent No.: US 6,786,334 B2
(45) Date of Patent: Sep. 7, 2004

(54) PROTECTIVE PACKAGING STRUCTURE FOR SHOCK SENSITIVE PRODUCTS AND CO-PACKAGED ACCESSORIES THEREFOR

(76) Inventor: Forrest Smith, 427½ Larkspur Ave., Corona del Mar, CA (US) 92625

( * ) Notice: Subject to any disclaimer, the term of this patent is extended or adjusted under 35 U.S.C. 154(b) by 124 days.

(21) Appl. No.: 10/247,715

(22) Filed: Sep. 20, 2002

(65) Prior Publication Data

US 2004/0055928 A1 Mar. 25, 2004

(51) Int. Cl.[7] ..... B65D 81/02
(52) U.S. Cl. ..... 206/592; 206/594
(58) Field of Search ..... 206/523, 586, 206/588, 589, 590, 591, 592, 594, 722

(56) References Cited

U.S. PATENT DOCUMENTS

| | | | | |
|---|---|---|---|---|
| 2,874,826 A | | 2/1959 | Matthews et al. | |
| 3,294,223 A | | 12/1966 | Goban | |
| 4,905,835 A | | 3/1990 | Pivert et al. | |
| 5,226,543 A | | 7/1993 | Foos et al. | |
| 5,259,508 A | * | 11/1993 | Beckerman | 206/587 |
| 5,385,232 A | | 1/1995 | Foos et al. | |
| 5,515,976 A | | 5/1996 | Moren et al. | |
| 5,626,229 A | | 5/1997 | Dickie et al. | |
| 5,628,402 A | | 5/1997 | Dickie et al. | |
| 5,706,951 A | * | 1/1998 | Oinuma et al. | 206/710 |
| 5,799,796 A | | 9/1998 | Azelton et al. | |
| 6,261,653 B1 | | 7/2001 | Smith | |

* cited by examiner

*Primary Examiner*—Jacob K. Ackun, Jr.
(74) *Attorney, Agent, or Firm*—Cahn & Samuels, LLP

(57) ABSTRACT

A unitary product cushioning structure for supporting a shock sensitive product in an outer packaging container, together with co-packaged accessories to be placed also in the same outer packaging container is formed of a moldable resilient plastics material. Shock absorption protection and impact protection from the co-packaged accessories during shock loading conditions in three mutually perpendicular directions is provided. A a product supporting region is defined by walls and a product supporting platform, and is surrounded by flexible shock absorbing spring transition sections arranged inwardly of outer container contacting walls. A void is formed beneath the platform, which is ribbed so as to provide a further barrier to protect the shock sensitive device from impact or contact from any co-packeged accessory.

7 Claims, 2 Drawing Sheets

PROTECTIVE PACKAGING STRUCTURE FOR SHOCK SENSITIVE PRODUCTS AND CO-PACKAGED ACCESSORIES THEREFOR

FIELD OF THE INVENTION

This invention relates to product cushioning devices for use in packaging shock sensitive products. In particular, the invention relates to re-usable or recyclable product cushioning devices which are made from plastics material, and which are particularly intended for use with shock sensitive products such as computers and computer components—particularly hard drives, CD and DVD drives, and the like. The configuration of cushioning devices in keeping with the present invention is particularly as a top or bottom tray, or an end cap. Product cushioning structures in keeping with the present invention comprise unitary structures which may be molded from a plastic material, using a variety of molding techniques.

BACKGROUND OF THE INVENTION

The use of product cushioning devices for shock sensitive products has been known for many years. Typically, cushioning for shock sensitive devices comprises a number of different approaches, each of which may have its own particular advantages and/or disadvantages.

For example, it has been known for many years to wrap shock sensitive or delicate devices or merchandise in tissue paper, and to cushion the products with loosely balled tissue paper. Another use of paper has been shredded paper, or excelsior. A more elegant approach has been to use bubble-pack, which comprises a sheet material having a plurality of contained bubbles of air formed therein. Another approach which has been used for many years has been the use of a plurality of discrete molded foamed polystyrene pellets, sometimes referred to as "peanuts" in the industry, to fill around a product in a container.

As the requirement for better packaging and cushioning became more demanding, for example with the introduction to the market of complicated and expensive electronics devices such as computer monitors, and more particularly notebook computers, printed circuit boards, and the like, the requirement arose for more sophisticated and better shock absorbing cushioning devices. Standards were developed for acceptance of cushioning devices, including drop tests and the like, to determine if such devices would protect the shock sensitive product from shock acceleration greater than the product's fragility level—typically, from 20 g's to 100 g's.

This has given rise to the use of such products as honeycomb cardboard, and particularly foamed polystyrene, foamed polyurethane, foamed polypropylene, or foamed polyethylene. Flexible foam devices are well known for use as corner pieces or edge pieces. Likewise, foamed polystyrene products—which are more rigid—are also well known for use as corner pieces or end caps; and very often, they are product specific in that they are particularly molded having a specific configuration for use with a particular product.

In general, however, flexible foam cushioning devices, and foamed polystyrene cushioning devices, are not recyclable. There are several reasons for that condition: The first is that flexible foam cushioning devices, and polystyrene cushioning devices, tend to be quite bulky, and are usually discarded with the packaging container in which the product has been shipped. There are very few specific recycling depots that are set up for either flexible foam or especially polystyrene cushioning devices; and, in any event, foamed polystyrene and foamed polyurethane cannot generally be recycled. Its re-usability may be provided for, particularly as general corner pieces, if they remain intact, or as product specific end caps; but, unless such foamed polystyrene cushioning devices are being used in a closed shipping system, they will not be recovered for re-use. Moreover, foamed polystyrene cushioning devices tend to be very frangible, and do not maintain their integrity very well once they have been used and removed from the packaging container in which they are shipped.

More elegant cushioning devices have more recently entered the market, comprising different types of blow-molded or other plastics shell products, most of which are closed structures which are filled with air or other gas. Some such structures are inflatable, some are closed, and some may be open to the atmosphere but are formed of a relatively rigid material. All such products are generally formed from high density polyethylene, which may be recycled because it is easily chopped up and made into further products, or such products may be re-usable if they are employed in a closed delivery and recovery system. Low density polyethylene may also be found in products such as those described immediately above, although its use is quite limited at the present time.

Some manufacturers of computer components such as hard drives, in particular, have an intent to ship accessories together with hard drives, in the same package, so that the accessories are co-packaged with the hard drive. The same holds true, particularly, for CD and DVD devices. The accessories will very often include such as a floppy disk or a CD, a mounting bracket, appropriate cables, and the like.

It is often desirable to package such accessories as those referred to above with the device with which they are associated, so as not to get lost or separated from the device. Indeed, distributors of such devices, and the like, may wish to include even further accessories such as additional software, special mounting brackets for their computer boxes, and the like, together with the device being shipped and protected by the protective packaging structures of the present invention.

Typically, additional accessories of the sort referred to herein, and others, are shipped in an additional corrugated cardboard box, or with a corrugated cardboard divider, or they are packaged with foam beads, or with an additional specially formed foam end cap, and the like. However, such packaging and shipping requires additional bulk of the shipping container within which the shock sensitive device is being shipped, they require additional material such as corrugated cardboard boxes or dividers, or foam, and they require additional shrink wrapping materials and the like.

Thus, a purpose of the present invention is to provide protection for shock sensitive devices without employing additional packaging material. In the event that the shock sensitive device is dropped or mishandled, use of the present invention precludes damage to the shock sensitive device such as might happen due to the impact of an accessory having substantial mass, for example a power cord or an instruction book—or an accessory might otherwise pierce a corrugated cardboard divider—such as a mounting bracket—and cause damage by scratching or otherwise damaging the case or exposed components on printed circuit boards which are often found at one side of shock sensitive devices such as hard drives and the like.

Moreover, all embodiments of the present invention, as described in greater detail hereafter, will provide cushioning and shock force absorption and/or transmission, and thus shock absorbing protection, for whatever shock sensitive product they are being used with, in three mutually perpendicular directions or along three mutually perpendicular axes for which shock absorption protection is required- vertical, front-to-back and side-to-side.

DESCRIPTION OF THE PRIOR ART

U.S. Pat. No. 2,874,826 issued to MATTHEWS et al is directed to a shock and vibration isolation device which, however, is not intended for being incorporated in a rectilinear container. Rather, this device is a resilient and inflatable jacket comprising a plurality of chambers, made of a rubberized fabric which is adapted to hold a gas under pressure, and which will be wrapped around a shock sensitive device such as a guided missile so as to provide a shock and vibration isolation container therefor.

GOBAN U.S. Pat. No. 3,294,223 teaches a molded plastic corner piece having the configuration of a triangular polyhedron which is either rounded or flattened at its apex. The purpose of the corner support is to entrap air between the molded plastic corner piece and the corner of the carton into which it is placed.

U.S. Pat. No. 4,905,835 issued to PIVERT et al. teaches inflatable cushion packaging wherein a plurality of chambers are inflated so as to provide cushioning which will absorb shock and thereby protect a shock sensitive product located in the centre of the container. The amount to which the balloon-like chambers may be inflated, and therefore their hardness, may be controlled.

FOOS et al. U.S. Pat. No. 5,226,543 teaches a packaging structure which includes both a platform portion and a sidewall portion, wherein the sidewall portion forms an enclosure around the platform portion. Essentially, this product is an end cap or platform. The sidewall has both inner and outer walls which are joined by a bridge section, and the inboard wall is relatively shorter than the outboard wall such that the platform portion holds the fragile article at a specific distance above the lower edge of the outboard wall. Shock absorbing formations—typically, notches—are formed in the bridge portion of the sidewall. These notches have a degree of elasticity such that, when the packaging structure is loaded and then unloaded, or shocked and then unloaded, the notch will return to its original shape and can absorb multiple loads without deteriorating. However, in order for the elasticity to exist, a material with a high degree of stiffness must be used—typically, that material is high density polyethylene. The patent requires that the inboard wall is shorter than the outboard wall.

Another patent issued to Foos et al. is U.S. Pat. No. 5,385,232. This patent also teaches a sidewall structure which forms an enclosure around a platform portion. However, the teachings of this patent also address the issue of light shock loads that may not deform or compress the shock load formations—the notches that are discussed in the previous Foos et al. patent. Here, the concept of openings which provide for collapsibility and allow for the release of compressed air beneath the package when the package is subject to shock loading, is introduced. These collapsible openings may be located in the platform at various locations, and may have a variety of shapes. Still, like the other Foos et al. patent, the teaching is directed to the use of inboard and outboard walls as well as the use of the shock formations (the notches) that have an elastic characteristic.

MOREN et al. U.S. Pat. No. 5,515,976 teaches a structure which has side flanges that are adapted to contact all sides of an end portion of a fragile article, and is thus configured as an end cap. There are a number of protrusions disposed throughout the sidewalls to support the article. There is also a notch provided in the side wall as a means to absorb shock loads. The end cap of this patent is also provided with at least one crush button for absorbing shocks applied along the longitudinal length of the fragile article.

Two related patents issued to DICKIE et al., U.S. Pat. Nos. 5,626,229 and 5,628,402 each are directed to a gas-containing product supporting structure which takes the form of a plastic bladder shaped on one side to provide a cavity having internal dimensions which match the external dimensions of the product to be protected, and shaped on its other side to have external dimensions which match the internal dimensions of the shipping container into which it is placed. The product is semi-rigid and self-supporting, monolithic, and gas-containing and may take the form of a corner piece or an end piece or tray for the product to be protected. The semi-rigid and self-supporting gas-containing bladder will retain its shape irrespective of whether it is sealed or open to the ambient surroundings; and will generally comprise a plurality of chambers in the interior of the product supporting structure with gas communication between the chambers so that the gas that is within the structure may flow from one chamber to another during shock loading circumstances of operation.

AZELTON et al. U.S. Pat. No. 5,799,796 teaches a unitary spring system end cap packaging unit. Here, the structure includes an inner wall, an outer wall, and a spring system disposed between them. The spring system includes at least one flexible harmonic bellows which forms a flexible ridge that has an arcuate shape along the length of the sidewall structure. A cushioning space exists between the edge of the inner sidewall and the edge of the outer sidewall. Dimples may be provided on the inner surfaces of the sidewall to allow a friction fit of the end cap to the product over which it will be placed. The arcuate harmonic bellows form flexible ridges that are elastic in nature; and each bellows of the spring system operates independently when a shock load is applied.

A co-pending United States Patent application in the name of the inventor herein, Ser. No. 09/286,843, filed Apr. 6, 1999, teaches a cushioning device which has a molded post as an integral part thereof. The post is designed to extend into an intersecting corner between two perpendicular packaging container sides, or into the corner formed by three mutually perpendicular packaging container sides. A product supporting surface is spaced away from a related packaging container side by a container contacting flange and a curved ridge. In a shock loading situation, the curved ridge will at least temporarily be further curved away from the post, and the product supporting surface will at least temporarily move closer to it's related packaging container side.

Two additional co-pending applications in the name of the present inventor are Canadian Patent Application Serial No. 2372480 filed Feb. 15, 2002 which particularly teaches protective packaging enclosures which are formed as a clamshell, into which shock sensitive devices such as hard drives, CD and DVD drives, motherboards, etc., can be placed; and U.S. patent application Ser. No. 09/490,848 filed Jan. 24, 2000, which teaches unitary product cushioning structures which may have a variety of configurations such as end caps, edge pieces, trays, and the like. The latter application provides shock absorption support for shock sensitive products in at least two of three mutually perpendicular directions, typically in all three, by the provision of an outer container contacting wall at each side which is intended to contact an outer packaging container.

Certain features of the latter US patent application are also found in the present application. However, the configuration of protective packaging structures in keeping with the present invention provides for a ribbed product supporting platform, and a void beneath the product supporting platform which is of sufficient volume to enclose co-packaged accessories, all of which are described and greater detail hereafter.

SUMMARY OF THE INVENTION

The present invention provides unitary product cushioning structures whose principal purpose is to support shock sensitive products in their respective outer packaging containers, as well as to permit co-packaged accessories to be placed also in the same outer packaging container together with the respective shock sensitive product. The present invention provides that the unitary product cushioning structures are formed of a moldable resilient plastics material.

The unitary product cushioning structure is adapted to provide shock absorption protection for a shock sensitive product during shock loading conditions in three mutually perpendicular directions.

Moreover, the unitary product cushioning structure of the present invention is further adapted to provide impact protection for a shock sensitive product from co-packaged accessories for that shock sensitive product, during shock loading conditions.

To that end, therefore, the unitary product cushioning structure comprises the following elements:

There are at least two pairs of outer container contacting walls which are arranged in mutually perpendicular orientations for providing contact with an outer packaging container in the same two mutually perpendicular directions as the mutually perpendicular orientations of the outer container contacting walls.

There is at least one flexible shock absorbing spring transition section formed inwardly of each of the outer container contacting walls. Each flexible shock absorbing spring transition section has an outer surface.

There is also a product supporting region having at least a pair of product contacting wall corner structures.

The product supporting region further comprises a product supporting platform which is arranged tp provide support in a mutually perpendicular orientation to the orientations of each of the outer container contacting walls.

Each of the wall corner structures has a pair of product contacting walls in mutually perpendicular orientation to the product supporting platform, a pair of outer product supporting region defining walls, and an upper ridge therebetween.

Each of the flexible shock absorbing spring transitions sections is formed inwardly of the respective outer container contacting wall with which it is associated, and outwardly of the outer product supporting region defining walls.

Each respective inner product contacting wall is adapted to provide shock absorption support for a product during shock loading conditions in a respective first or second one of the three mutually perpendicular directions.

The product supporting platform is adapted to provide shock absorption support for a product during shock loading conditions in a direction perpendicular thereto, and thus perpendicular to the first or second ones of the three mutually perpendicular directions. Accordingly, shock absorption protection is provided for a shock sensitive product during shock loading conditions, in three mutually perpendicular directions.

The product supporting platform has a plurality of ribs formed therein, each extending perpendicularly in a direction away from the product supporting platform to a lower extent limit.

Each of the outer container contacting walls has a bottom edge which provides an outer packaging container contacting surface to contact a surface of an outer packaging container which is in a plane that is mutually perpendicular to the planes of the pairs of inner product contacting walls.

The vertical distance between the plane of the bottom edges and the plane of the lower extent limit is at least as great as the thickness of any accessory for a shock sensitive product to be supported by the product supporting platform.

Thus, a void is defined between the lower extent of each of the plurality of ribs and the plane of the bottom edges, and between the flexible shock absorber spring transitions sections associated with the outer container contacting walls.

Accordingly, an accessory may be co-packaged with a related shock sensitive product by being placed within the void.

Typically, the at least a pair of product contacting wall corner structures are arranged so as to be diagonally opposed one to another.

Typically, the unitary product cushioning support structure of-the present invention may also be formed so as to have at least one flexible joint that surrounds the product supporting platform.

Another provision of the present invention is that at least one of the flexible shock absorbing spring transitions sections associated with each of the at least one of the least two pairs of outer container contacting walls made be formed in at least two portions. If so, each portion is separated from the other by a stiffening rib which extends inwardly from the respective outer container contacting wall towards the product supporting platform.

Also, typically each flexible shock absorbing spring section is curved, with the direction of the curve being inwardly and away from the respective outer container contacting wall.

In general, unitary product cushioning structures in keeping with the present invention are thermoformed from sheet plastics material. Thus, the compression strength of the molded unitary structure, and thereby its ability to withstand the shock forces, will vary as a function of the thickness of the thermoformed sheet plastics material from which the molded unitary product cushioning support structure has been thermoformed.

Still further, the compression strength of a molded unitary product cushioning structure in keeping with the present invention, thereby its ability to withstand shock forces, will vary as a function of the width and depth of each flexible shock absorbing spring transition section formed in the molded unitary product cushioning structure.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
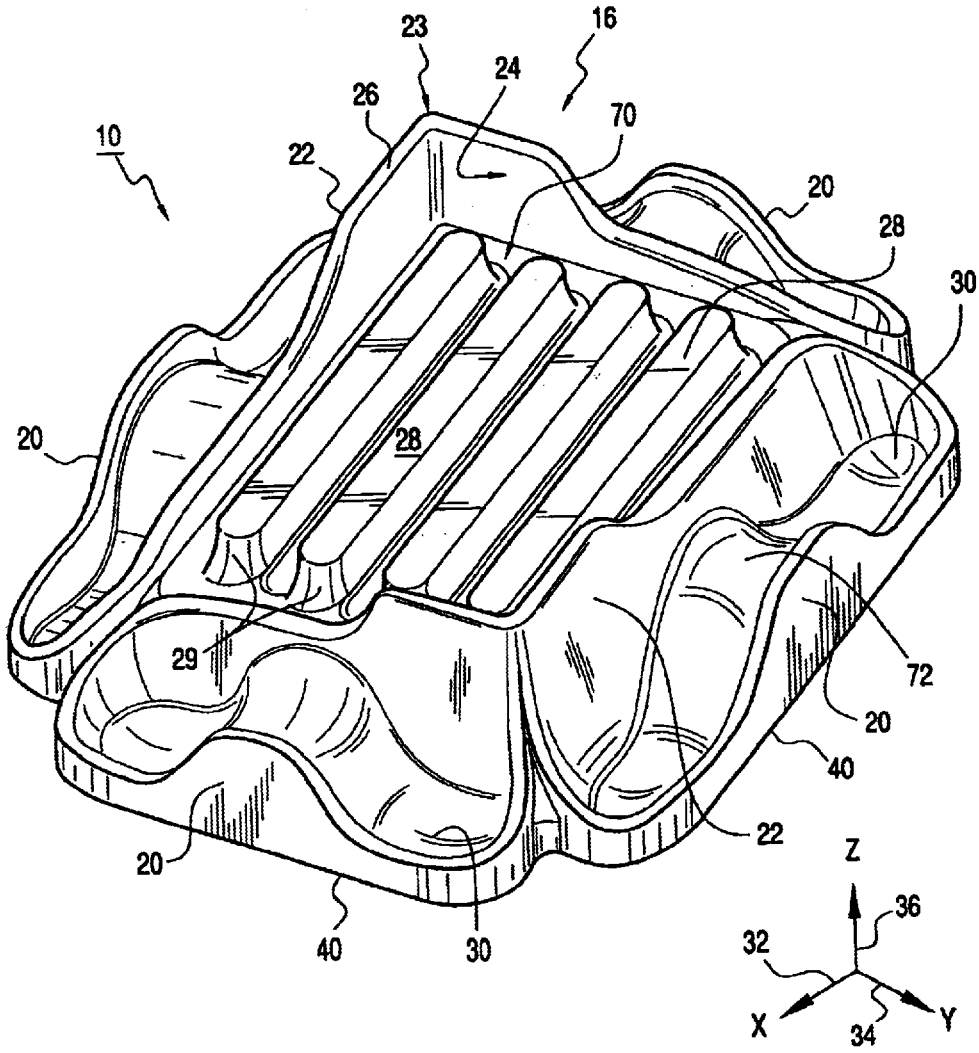
FIG. 1 is a perspective view of a typical embodiment of a unitary product cushioning structure in keeping with the present invention, when viewed from the top.

Turning first to FIG. 1, there follows some discussion to introduce some of the basic concepts and premises surrounding design and function of unitary product cushioning structures in keeping with the present invention, and to introduce the terminology which is particularly employed herein.

A typical unitary product cushioning structure in keeping with the present invention is shown at 10 in FIG. 1. It is intended for use with a shock sensitive product, not shown. The precise nature of the product is immaterial to the operation and function of the present invention, except that it is a shock sensitive product such as a hard drive, CD and DVD drive, motherboard, and the like, which is intended to be co-shipped with accessories such as floppy discs or CDs, mounting brackets, instruction booklets, and the like.

The principal components of any unitary product cushioning structure in keeping with the present invention, comprise the following: each unitary product cushioning structure will comprise at least two pairs of outer container contacting walls 20, in opposed relation, as shown in FIG. 1. In the upper region of the unitary product cushioning structure, as can be seen in FIG. 1, there is a product supporting region 16. It is bounded and defined by at least a pair of product contacting wall corner structures 23. Typically, the product contacting wall corner structures 23 are diagonally opposed one to the other, and thud are arranged at opposed corners of the product supporting region 16 as seen in FIG. 1.

Each of the product contacting wall corner structures 23 comprises a pair of inner product contacting walls 24, a pair of outer product supporting region defining wall 22, and an upper ridge 26 therebetween. The pair of inner product contacting walls 24 are arranged in perpendicular relationship one to the other.

The lower portion of the product supporting region 16 terminates in a product supporting platform 28.

The product supporting platform 28, in fact, comprises a-plurality of ribs 29, described in greater detail hereafter.

Between each outer container contacting wall 20 and the respective outer product supporting region defining wall 22, or extension thereof, there is a flexible shock absorbing spring transition section or sections 30. Typically, each flexible shock absorbing spring transition 30 has a curved configuration, with the direction of the curve being inwardly from the respective outer container contacting wall 20 towards the respective outer product support region defining wall 22.

For ease of discussion, three mutually perpendicular axises 32, 34, and 36 are shown in FIG. 1 representing "X"-axis, "Y"-axis, and "Z"-axis, respectively. Typically, the "Z"-axis is vertical; however, if any unitary product cushioning structure in keeping with the present invention, having a configuration such as that shown in FIG. 1, is used as a end cap rather than top or bottom tray, than actual verticality might be in the direction of either the "X"-axis or the "Y"-axis, depending on the orientation in which the outer packaging container in which the shock sensitive product, its respective unitary product cushioning structure, and its respective co-packaged accessories, have been placed.

Figure 2:
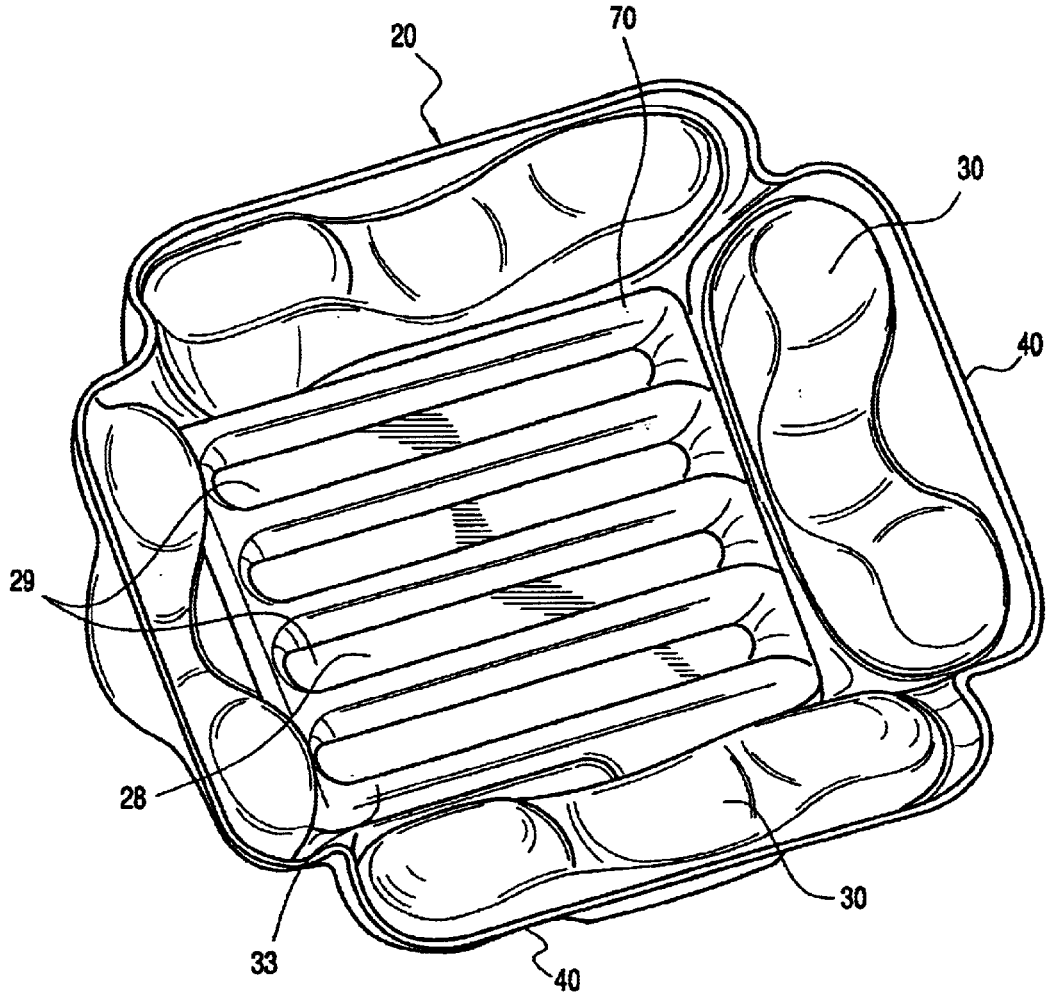
FIG. 2 is a perspective view of the embodiment of FIG. 1, when viewed from the bottom.

Referring to FIG. 2, the embodiment of FIG. 1 is shown in an upside down configuration. It has been noted that the product supporting platform 28 is actually formed with a plurality of ribs 29 formed therein. Each of the ribs 29 extends perpendicularly in a direction away from the product supporting platform 28 to a lower extent limit, as can be understood from an inspection of FIG. 2.

Also, each of the outer container contacting walls 20 has a bottom edge 40 which provides an outer packaging container contacting surface when placed into a container. The outer packaging container contacting surface at edge 40 contacts a surface of an outer packaging container, which surface will be in a plane that 5 perpendicular to the planes of the pair of inner product contacting walls 24.

The lower extent limit of the ribs 29 is shown generally at 33 in FIG. 2.

It will be understood that the product supporting platform 28 is such as to provide product support in a mutually perpendicular orientation to the orientation of each of the outer container contacting walls 20. However, it will also be understood that in some circumstances the specific configuration of the product supporting platform may be concave or slanted, while still providing product support in a direction which is mutually perpendicular to the orientation of each of the outer product contacting walls 20.

It will also be understood from an inspection of FIG. 2 that the vertical distance between the plane of the bottom edges 40 and the plane of the lower extent limit 33, is at least as great as the thickness of any accessory for a shock sensitive product to be supported by the product supporting platform 28. That is to say, a void is defined between the lower extent 33 of each of the plurality of ribs 29 and the plane of the bottom edges 40, and between the flexible shock absorber spring transitions sections 30 associated with the pairs of outer container contacting walls 20.

It will be appreciated that the nature of the ribbed product supporting platform 28 is thereby such that a buffer area is provided between the shock sensitive device and any accessories therefor which may be placed into the void beneath the product supporting platform 28. Those ribs, and the buffer which they form, effectively preclude impact damage by any accessory, by precluding contact of the accessory with the shock sensitive product. Moreover, by eliminating the use of plastic or corrugated cardboard separators, boxes, and the like, and the provision of the buffer region provided by the ribs 29, the likelihood of such as a bracket which may have sharp edges scratching the surface of the shock sensitive product, or more dangerously damaging an exposed printed circuit board and any components mounted thereon, is precluded.

Thus, it can be seen that unitary product cushioning structures in keeping with the present invention permit co-packaging of accessories, which may have substantial mass and therefore substantial momentum in a shock loading condition to which the shock sensitive product is subjected.

Typically, the product supporting platform 28 is also surrounded by a flexible joint 70, the underside of which is clearly seen in FIG. 2. The flexible joint 70 is formed at the intersection of the inner product containing walls 24 or extensions thereof, with an extension of the product supporting platform 28. Thus, the flexible joint 70 provides additional shock absorbing protection.

Moreover, some embodiments of unitary product cushioning structures in keeping with the present invention may be formed in such a manner that the flexible shock absorbing spring transition sections 30 are formed in at least two portions, each separated one from another by a stiffening rib 72, as shown particularly in FIG. 1.

It will be understood, of course, particularly from an inspection of each of FIGS. 1 and 2, that the flexible shock absorbing springs sections 30 are curved, with the direction of the curve being inwardly and downwardly, away from the respective outer container contacting wall 20.

Typically, unitary product cushioning structures in keeping with the present invention are thermoformed or vacuum formed, but they might in some circumstances be molded using other plastics molding techniques such as injection molding or blow molding or slush molding. It will also be understood, of course, that the compression strength of a molded unitary structure in keeping with the present invention, and thereby its ability to withstand shock forces, will vary as a function of the width and depth of each flexible shock absorbing spring transitions section 30 formed in the molded unitary product cushioning structure 10.

It will be understood that any container contacting wall 20 will provide contact with an outer packaging container in at least one of the three mutually perpendicular directions, it being considered and assumed that, in all instances, the outer packaging container is essentially rectilinear in configuration.

Shock absorbing protection is provided at least by the presence of the flexible shock absorbing spring transitions sections 30. The flexible shock absorbing spring transition section 30 is designed to momentary collapse in a direction towards the outer container contacting wall 20, if the shock load is in a respective "X"-axis or "Y"-axis direction. If the shock load is in the "Z"-axis direction, having regard to the configuration of FIG. 1 and the direction of the axes as shown in that figure, then the flexible shock absorbing spring transition sections will also flex as a consequence either of the contact between them and the outer packaging container, or as a consequence of the reaction between the flexible shock absorbing spring transition section 30 and the bottom surface 40 of the outer container contacting walls 20.

Still further, of course, an additional shock absorbing protection is provided in the "Z"-axis direction by the presence of the ribs 29 and, when present, the flexible joint 70.

Thus, when any unitary product cushioning structure in keeping with the present invention is used as an end piece, or as a top or bottom tray, to protect shock sensitive products and devices, then the shock protection will be provided in all three mutually perpendicular directions.

Moreover, by placing accessories for the shock sensitive device in the void beneath the lower extent of the ribs, but above the bottom edges 40, as described above, impact with the shock sensitive device as a consequence of the momentum of such accessories in a shock absorbing condition is precluded.

Typically, as can be understood from inspection of FIGS. 1 and 2, each of the outer container contacting walls 20, and each of the outer product supporting region defining walls 22 and the inner product contacting walls 24, may be sloped inwardly and upwardly. This will permit similar unitary product cushioning structures in keeping with the present invention to be stackable. That feature is useful when, for example, unitary products structures of the present invention are thermoformed or otherwise molded in a factory at one location, and are shipped to a customer for use with that customer's shock sensitive products which are being manufactured and packaged in another location. Obviously, stackability reduces shipping costs, and that results in lower prices to the shock sensitive product manufacturer and ultimately in lower prices to the end consumer of the shock sensitive product.

Particularly when the unitary product cushioning structure of the present invention is thermoformed from a sheet plastics material, the compression strength of the molded unitary structure, and thereby its ability to withstand shock forces, may vary as a function of the thickness of the thermoformable sheet plastic material, from which the molded unitary product cushioning structure has been thermoformed. For example, similar designs of unitary product cushioning structure manufactured from thermoformable sheet plastics material having an initial thickness of 0.080 inches will vary considerably from those manufactured from thermoformable sheet plastics material having an initial thickness of, for example, 0.100 inches, or 0.050 inches. The decision is, of course, determined as a matter of the knowledge of the designer and of the purchaser, of the end purpose to which the unitary product cushioning structure will be put. Obviously, shock sensitive products having the same size but weighing two or three times as much as other shock sensitive products will require unitary product cushioning structures which are thermoformed from thicker sheet plastics materials.

It will be noted from the drawings that each flexible shock absorbing spring transition section is curved, and the direction of that curve is outwardly and away from the respective outer product supporting region defining wall 22, to which it is adjacent. Moreover, the compression strength of the molded unitary structure itself, and thereby its ability to withstand shock forces, may also vary as a function of the width and depth—in other words, the amount of curvature—of each flexible shock absorbing spring transition section 30.

Generally, the elasticity of any plastics material from which the unitary product cushioning structures of the present invention are manufactured, is such that there is no permanent deformation of the unitary product cushioning structures of the present invention, when they have been put to the task of absorbing shock loading so as to protect the shock sensitive product that is in them.

To that end, drop tests on a variety of embodiments of unitary product cushioning structures in keeping with the present invention, having differing sizes and being intended for different purposes have indicated, in each instance, the ability of the unitary product cushioning structures of the present invention to meet all drop test standards. Those standards vary from case to case, depending on the product to be protected, the size and nature of the product cushioning structure, the nature of the outer packaging container, and so on. Generally, a unitary product cushioning structure in keeping with the present invention will reduce the impact forces that are imparted to the shock sensitive product being cushioned, to less than 100 g's. Typically, a level of 50 g's to 60 g's for a drop of about 1 meter is obtained by unitary product cushioning structures in keeping with the present invention.

As noted, the molding techniques which may be employed to manufacture unitary product cushioning structures in keeping with the present invention may include drape molding, vacuum molding, blow molding, slush molding, or injection molding. Typically, thermoforming is the molding process which is employed. Any molding technique, however, which may be employed is wellknown to those skilled in the plastics arts, and requires no further discussion herein.

Typical materials from which unitary product cushioning devices of the present invention may be molded include low density polyethylene, high density polyethylene, polyvinylchloride, PET, polystyrene, nylon, polypropylene, and appropriate mixtures and co-polymers thereof. However, it will be understood that the above list of materials is intended to be illustrative but not exhaustive.

There has been described a unitary product cushioning structure, which provides excellent shock protection for shock sensitive products and which also permits co-packaging of accessories items for those shock sensitive products or devices.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed is:

1. A unitary product cushioning structure for supporting a shock sensitive product in an outer packaging container, and for permitting co-packaged accessories to be placed also in the same outer packaging container together with a shock sensitive product, said unitary product cushioning structure being formed of a moldable resilient plastics material;

wherein said unitary product cushioning structure is adapted to provide shock absorption protection for a shock sensitive product during shock loading conditions in three mutually perpendicular directions; and wherein said unitary product cushioning structure is further adapted to provide impact protection for a shock sensitive product from co-packaged accessories for said shock sensitive product, during shock loading conditions;

said unitary product cushioning structure comprising:

at least two pairs of outer container contacting walls being arranged in mutually perpendicular orientations for providing contact with an outer packaging container in the same two mutually perpendicular directions as said mutually perpendicular orientations;

at least one flexible shock absorbing spring transition section formed inwardly of each of said outer container contacting walls, each flexible shock absorbing spring transition section having an outer surface; and a product supporting region having at least a pair of product contacting wall corner structures;

wherein said product supporting region further comprises a product supporting platform to provide product support in a mutually perpendicular orientation to the orientation of each of said outer container contacting walls;

wherein each of said wall corner structures has a pair of inner product contacting walls in mutually perpendicular orientation to said product supporting platform, a pair of outer product supporting region defining walls, and an upper ridge therebetween;

wherein each of said flexible shock absorbing spring transition section is formed inwardly of the respective outer container contacting wall with which it is associated, and outwardly of said outer product supporting region defining walls;

wherein each respective inner product contacting wall is adapted to provide shock absorption support for a product during shock loading conditions in a respective first or second one of said three mutually perpendicular directions;

wherein said product supporting platform is adapted to provide shock absorption support for a product during shock loading conditions in a direction perpendicular thereto, and perpendicular to said first or second one of said three mutually perpendicular directions, whereby shock absorption protection is provided for a shock sensitive product during shock loading conditions, in three mutually perpendicular directions;

wherein said product supporting platform has a plurality of ribs formed therein, each extending perpendicularly in a direction away from said product supporting platform to a lower extent limit; and wherein each of said outer container contacting walls has a bottom edge which provides an outer packaging container contacting surface to contact a surface of an outer packaging container which is in a plane that is mutually perpendicular to the planes of said pairs of inner product contacting walls;

wherein the vertical distance between the plane of said bottom edges and the plane of said lower extent limit is at least as great as the thickness of any accessory for a shock sensitive product to be supported by said product supporting platform;

whereby a void is defined between said lower extent of each of said plurality of ribs and the plane of said bottom edges, and between said flexible shock absorber spring transition sections associated with said outer container contacting walls; and whereby an accessory may be co-packaged with a related shock sensitive product by being placed within said void.

2. The unitary product cushioning structure of claim 1, wherein said at least a pair of product contacting wall corner structures are arranged so as to be diagonally opposed one to another.

3. The unitary product cushioning structure of claim 1, wherein at least one flexible joint is formed so as to surround said product supporting platform.

4. The unitary product cushioning structure of claim 1, wherein at least one of said flexible shock absorbing spring transition sections associated with each of at least one of said at least two pairs of outer container contacting walls is formed in at least two portions, each separated one from another by a stiffening rib extending inwardly from the respective outer container contacting wall towards said product supporting platform.

5. The unitary product cushioning structure of claim 1, wherein each flexible shock absorbing spring section is curved, with the direction of said curve being inwardly and away from the respective outer container contacting wall.

6. The unitary product cushioning structure of claim 1, wherein said unitary product cushioning structure is thermoformed from sheet plastics material, and wherein the compression strength of the molded unitary structure, and thereby its ability to withstand shock forces, varies as a function of the thickness of the thermoformable sheet plastics material from which the molded unitary product cushioning structure has been thermoformed.

7. The unitary product cushioning structure of claim 1, wherein the compression strength of the molded unitary structure, and thereby its ability to withstand shock forces, varies as a function of the width and depth of each flexible shock absorbing spring transition section formed in said molded unitary product cushioning structure.

* * * * *